US008348373B2

(12) United States Patent
Martin et al.

(10) Patent No.: US 8,348,373 B2
(45) Date of Patent: Jan. 8, 2013

(54) FIRING SIGNAL FORWARDING IN A FLUID EJECTION DEVICE

(75) Inventors: Eric T. Martin, Corvallis, OR (US); Michael W. Cumbie, Albany, OR (US); Mark H. MacKenzie, Corvallis, OR (US); Volker Smektala, Camas, WA (US); Matthew A. Shepherd, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 281 days.

(21) Appl. No.: 12/867,053

(22) PCT Filed: Mar. 12, 2008

(86) PCT No.: PCT/US2008/056646

§ 371 (c)(1),
(2), (4) Date: Aug. 11, 2010

(87) PCT Pub. No.: WO2009/114012

PCT Pub. Date: Sep. 17, 2009

(65) Prior Publication Data

US 2010/0328391 A1 Dec. 30, 2010

(51) Int. Cl.
*B41J 29/38* (2006.01)
*B41J 2/05* (2006.01)

(52) U.S. Cl. ..... 347/14; 347/60

(58) Field of Classification Search ..... None
See application file for complete search history.

(56) References Cited

U.S. PATENT DOCUMENTS

| | | | | |
|---|---|---|---|---|
| 4,490,728 | A | 12/1984 | Vaught et al. | |
| 5,281,980 | A | 1/1994 | Kishida | |
| 5,838,340 | A * | 11/1998 | Shimoda | 347/14 |
| 6,145,948 | A * | 11/2000 | Kishida | 347/13 |
| 6,296,350 | B1 | 10/2001 | Cornell et al. | |
| 6,431,685 | B1 | 8/2002 | Misumi | |
| 2002/0047873 | A1 | 4/2002 | Imanaka | |
| 2005/0007403 | A1 | 1/2005 | Lee | |

FOREIGN PATENT DOCUMENTS

| | | |
|---|---|---|
| EP | 0658429 | 6/1995 |
| JP | 06326722 | 11/1994 |
| JP | 07323550 | 12/1995 |
| JP | 09277580 | 10/1997 |
| JP | 2002019160 | 1/2002 |

OTHER PUBLICATIONS

Supplementary European Search Report for Application No. EP08743795.0. Report issued Apr. 6, 2011.

* cited by examiner

*Primary Examiner* — Geoffrey Mruk
*Assistant Examiner* — Bradley Thies

(57) ABSTRACT

A method for forwarding a firing signal within a nozzle group of a fluid ejection device includes receiving warm data and fire data. A firing signal having a firing pulse preceded by a warming pulse is received. The firing signal is conditionally modified according to of the fire data. The conditionally modified firing signal is forwarded to a particular nozzle circuit of the nozzle group.

20 Claims, 5 Drawing Sheets

FIRING SIGNAL FORWARDING IN A FLUID EJECTION DEVICE

BACKGROUND

Fluid ejection devices such as printer ink cartridges use resistors formed on an integrated circuit to vaporize fluid held in a chamber, ejecting a droplet of fluid through a nozzle. For various reasons it can be beneficial to preheat the fluid prior to vaporization. Trickle warming is an exemplary pre-heating technique. Prior to ejecting fluid, a first transistor formed on the integrated circuit switches a "trickle" current. The current causes the resistor or the first warming transistor to pre-heat but not vaporize fluid in a chamber. Subsequently, a second firing transistor formed on the integrated circuit switches a firing current to the resistor. The firing current causes the resistive element to vaporize the fluid. The use of two transistors, however, can consume significant area on the integrated circuit that could otherwise be used for any number of other purposes. Moreover, trickle warming can prove to be inefficient in that a substantial portion of the energy used to heat the ink is dissipated in the integrated circuit instead of the ink.

DRAWINGS

DETAILED DESCRIPTION

Introduction

Embodiments described below were developed in an effort to reduce area of an integrated circuit of a fluid ejection device dedicated to preheating. The warming transistor has been removed from the circuitry of each nozzle. Instead, a pulse width modulated signal is supplied to a transistor. The transistor then switches a corresponding pulse signal to a resistor. The signal includes a precursor warming pulse shaped to cause the resistor to heat but not nucleate fluid in a vaporization chamber. The precursor pulse is followed by a dead time and then a firing pulse. The firing pulse is shaped to cause the resistor to vaporize the fluid in the vaporization chamber. Vaporization causes fluid expansion ejecting a drop through a nozzle.

Figure 1:
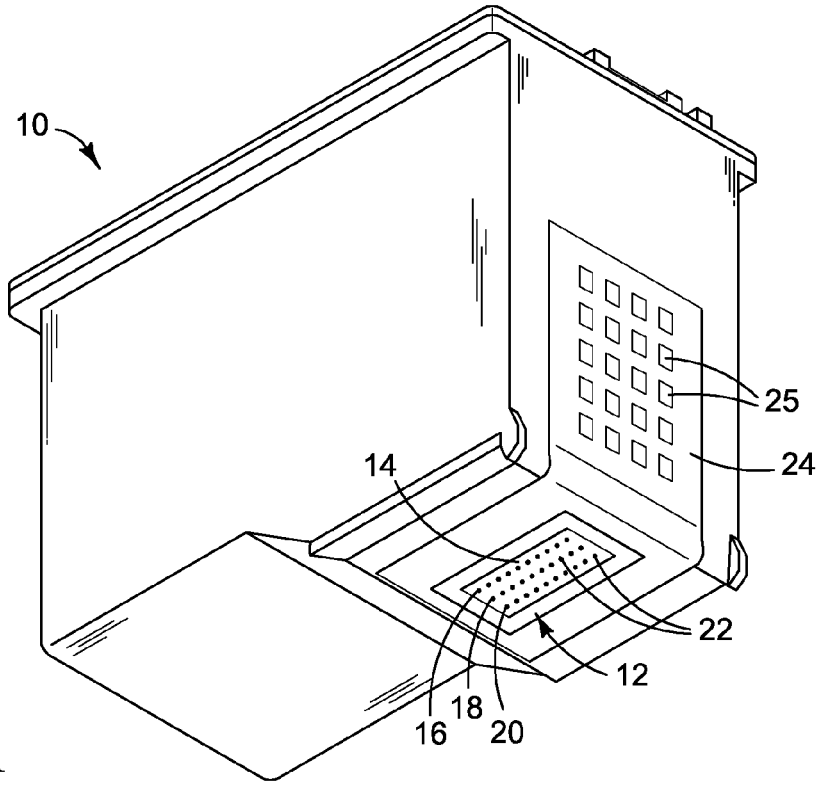
FIG. 1 is a perspective view illustrating the exterior of an ink cartridge.

Environment:

FIG. 1 is a perspective view of an exemplary fluid ejection device in the form of ink cartridge 10. Cartridge 10 includes a print head 12 located at the bottom of cartridge 10 below an internal ink holding chamber. Print head 12 includes a nozzle plate 14 with three groups 16, 18, and 20 of nozzles 22. In the embodiment shown, each group 16, 18, and 20 is a row of nozzles 22. A flexible circuit 24 carries electrical traces from external contact pads 28 to print head 12. When ink cartridge 10 is installed in a printer, cartridge 10 is electrically connected to the printer controller through contact pads 30. In operation, the printer controller selectively communicates firing and other signals to print head 12 through the traces in flexible circuit 24.

Figure 2:
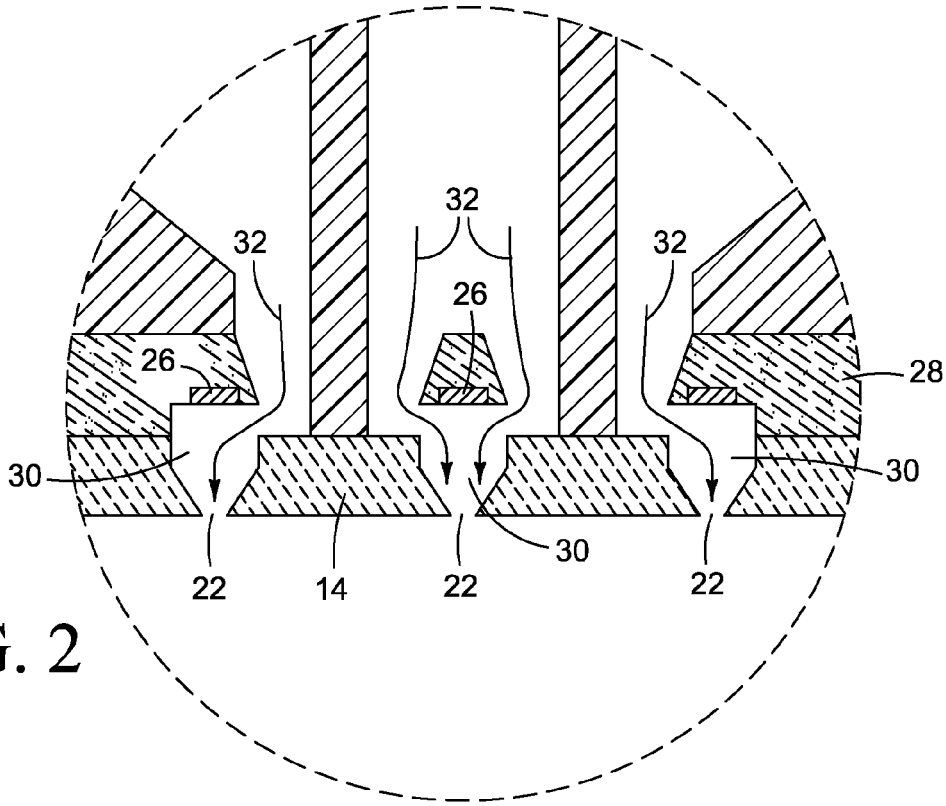
FIG. 2 is a detail section view showing a portion of the print head in the cartridge of FIG. 1.

FIG. 2 is a detail section view showing a portion of the print head 12 in the cartridge 10 of FIG. 1. Firing elements 26 are formed on an integrated circuit 28 and positioned behind ink ejection nozzles 22. When a firing element 26 is sufficiently energized, ink in a vaporization chamber 30 next to a firing element 26 is vaporized, ejecting a droplet of ink through a nozzle 22 on to the print media. The low pressure created by ejection of the ink droplet and cooling of chamber 30 then draws in ink to refill vaporization chamber 30 in preparation for the next ejection. The flow of ink through print head 12 is illustrated by arrows 32. Firing elements 26 represent generally any device capable of being heated by an electrical signal. For example, firing elements 26 may be resistors or other electrical components that emits heat as a result of an electrical current passing through the component.

Figure 3:
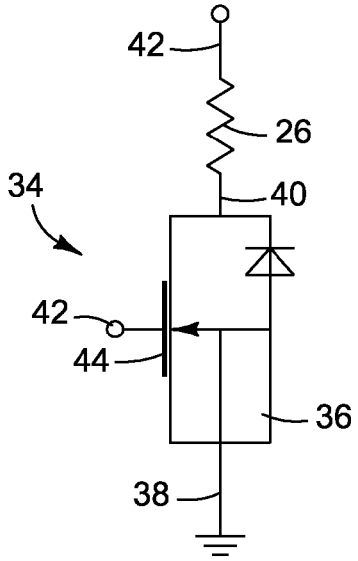
FIG. 3 is a circuit diagram of the firing circuitry for a nozzle according to an embodiment.

Components:

FIG. 3 is a diagram of an exemplary nozzle circuit 34. Referring also to FIG. 2, each nozzle 22 has a corresponding nozzle circuit 34 formed on integrated circuit 28. Each nozzle circuit 34 includes a firing element 26 and a switching element 36. Switching element 36 represents generally any component capable of switching a current representative of a firing signal through firing element 26. A firing signal is an electrical signal applied to switching element 36 that causes the switching element to pass a current representative of the firing signal through fire element 26. In the example of FIG. 3, switching element 36 is a field effect transistor often referred to as a FET. Switching element 36 includes a source 38, a drain 40, and a gate 42. The source 38 is coupled to ground while the drain 40 is coupled to one terminal of firing element 26. The other terminal of firing element 26 is coupled to a voltage source 42. Referring to FIG. 2, the voltage source is supplied via a trace on flexible circuit 24. Switching element 36 is normally "off" preventing current from flowing through firing element 26. With a proper firing signal applied to the gate 42, switching element 36 switches "on" allowing voltage source 42 to pass a current through firing element 26.

Figure 4:
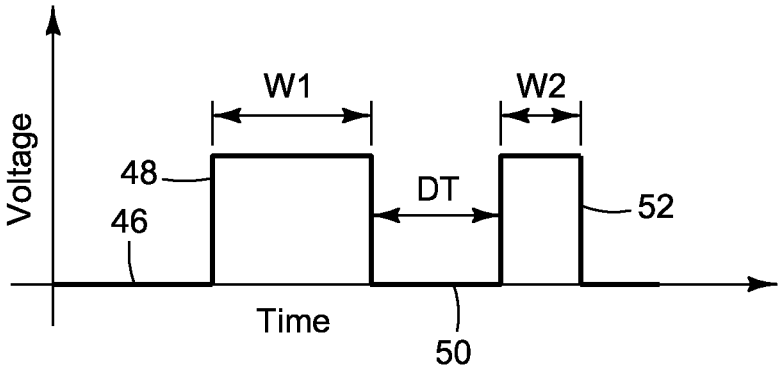
FIG. 4 is a graph of an exemplary unconditioned firing signal according to an embodiment.

FIG. 4 illustrates an exemplary pulse width modulated firing signal 46 to be applied to the gate of switching element 36. Signal 46 includes a warming pulse 48, dead time 50, and firing pulse 52. Warming pulse 48 represents a high portion of signal 46 having a duration or width (W1) that is long enough to switch current through firing element 26 to warm fluid in an adjacent chamber 30 (FIG. 2) but not long enough to vaporize and eject the fluid through a nozzle 22 (FIGS. 1 and 2). Firing pulse 52 represents a high portion of signal 46 having a duration or width (W2) that is long enough to switch current through firing element 26 to vaporize the pre-heated fluid in a chamber 30. Dead time 50 represents a low portion in signal 46 between the warming pulse 48 and the firing pulse 52. Dead time is low in that the firing signal is insufficient to cause switching element 36 to switch current through firing element 26. In other words, during dead time 50, switching element 36 is switched off preventing current from flowing through firing element 26.

Inserting dead time 50 between the warming and firing pulses 48 and 52 can improve consistency in drip shape, velocity, and direction. Inclusion of dead time 50 can also improve the reliability of the print head 12 while allowing for a simpler control system. For example, the actual width (in time) of dead time 50 is not as important as the widths of warming pulse 48 and firing pulse 52. Consequently, the locations (in time) of the rising edges of warming pulse 48 and firing pulse 52 can be fixed. The timing of the falling edges can then be adjusted to provide the appropriate warming and firing pulse widths W1 and W2.

Figure 5:
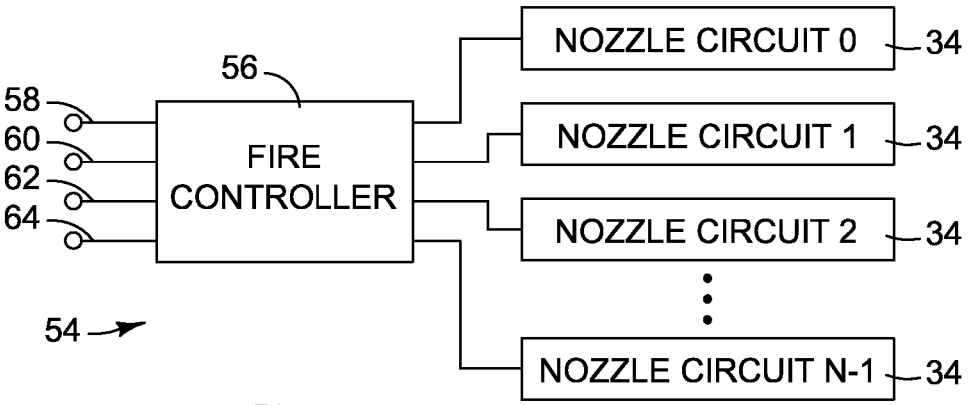
FIG. 5 is a block diagram of a nozzle group according to an embodiment.

FIG. 5 is a block diagram of an exemplary nozzle group 54. Nozzle group 54 is a group of nozzle circuits 36 being driven by a fire controller 56. In this example, nozzle group 54 includes M nozzle circuits 34. Fire controller 56 represents generally any integrated circuit capable of receiving and conditionally modifying a firing signal and forwarding the conditionally modified firing signal to a selected nozzle circuit 36. Fire controller 56 has a firing signal input 58, an address data input 60, a warm data input 62, and a fire data input 64. Firing signal input 58 represents generally any interface through which fire controller 56 can receive a firing signal such as firing signal 46 of FIG. 4. Address data input 60 represents generally any interface through which fire controller 56 can receive address data. Address data is data identifying a particular one of the M nozzle circuits 34. For example, address data may take the form of a binary signal whose bits identify a particular nozzle circuit 34 of the M nozzle circuits 34.

Warm data input 62 represents generally any interface through which fire controller 56 can receive warm data. Warm data is data indicating whether or not fire controller 56 is to modify a firing signal to remove a warming pulse. Warm data may, for example, be a single bit binary signal having either an active or inactive state. An inactive state indicates that the fire controller 56 is to modify a firing signal to block or otherwise remove the warming pulse. An active state indicates that the warming pulse is to remain.

Fire data input 64 represents generally any interface through which fire controller 56 can receive fire data. Fire data is data indicating whether or not fire controller 56 is to modify a firing signal to remove a firing pulse. Fire data may, for example, be a single bit binary signal having either an active or inactive state. An inactive state indicates that the fire controller 56 is to modify a firing signal to block or otherwise remove the firing pulse. An active state indicates that the warming pulse is to remain. In an exemplary embodiment, an active state for the firing signal may also indicate that the warming pulse is to remain without regard to the active or inactive state of the warm data.

While fire controller 56 is shown to include separate inputs for address data, warm data, and fire data. Two or three of these inputs may be combined as a single input. Two or more of the address data, warm data, and fire data could be joined as a common binary signal with certain bits representing the address data, another bit representing the warm data, and another bit representing the fire data.

Figure 6:
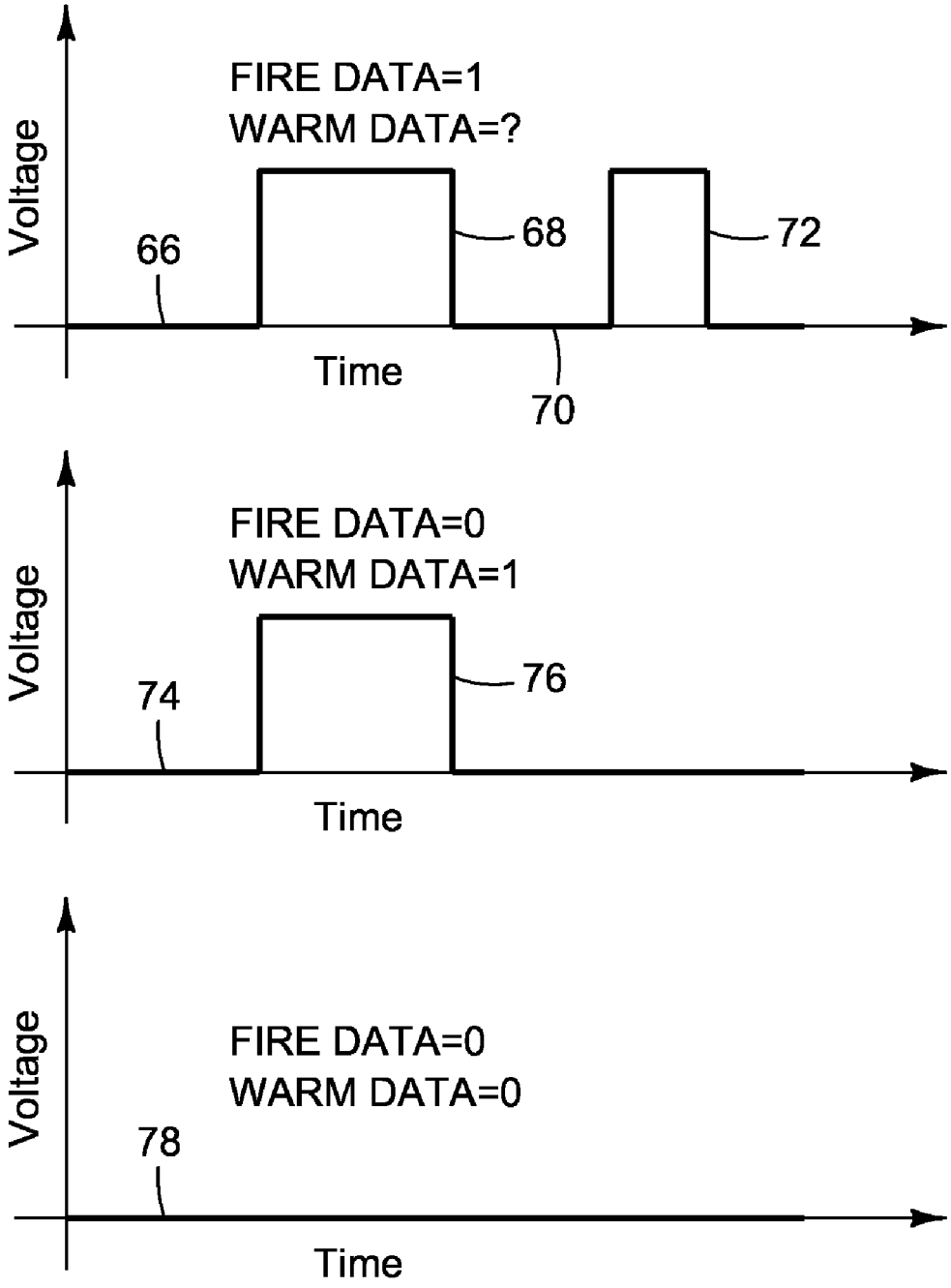
FIG. 6 is a graph of three conditioned firing signals according to an embodiment.

FIG. 6 illustrates three firing signals 66, 74, and 78 conditionally modified by fire control 56 of FIG. 5 according to the active or inactive states of warm data and fire data received via warm data input 62 and fire data input 64. With respect to conditionally modified signal 66, fire controller 56 has received fire data having an active state represented by the value of one. Alternatively the value zero could represent an active state and the value one could represent an inactive state. Since the fire data has an active state, fire controller 56, without regard to warm data received, conditionally modifies a firing signal received via firing signal input 58 by not modifying the firing signal. As such, the conditionally modified signal 66 includes warming pulse 68 followed by dead time 70 and then firing pulse 72.

With respect to conditionally modified signal 74, fire controller 56 has received fire data having an inactive state represented by the value of zero and warm data having an active state represented by the value of one. Fire controller 56 conditionally modifies a firing signal received via firing signal input 58 by removing or otherwise negating the firing pulse. As such, the conditionally modified signal 74 only includes warming pulse 76 followed by dead time. Such a scenario may occur while printing when it is determined that the ink temperature is below a target value, so that every fire signal 46 that is not used to fire ink is at least used to warm the ink. Such a scenario may also occur during initialization, that is, before starting a print job. The printer may warm up the ink to a target temperature by sending fire signals 46 to the print head with warm data set to an active state and fire data set to an inactive state until the ink reaches the target temperature.

With respect to conditionally modified signal 78, fire controller 56 has received fire data having an inactive state represented by the value of zero and warm data having an inactive state represented by the value of zero. Fire controller 56 conditionally modifies a firing signal received via firing signal input 58 by removing or otherwise negating the firing pulse and the warming pulse. As such, the conditionally modified signal 78 only includes dead time.

Figure 7:
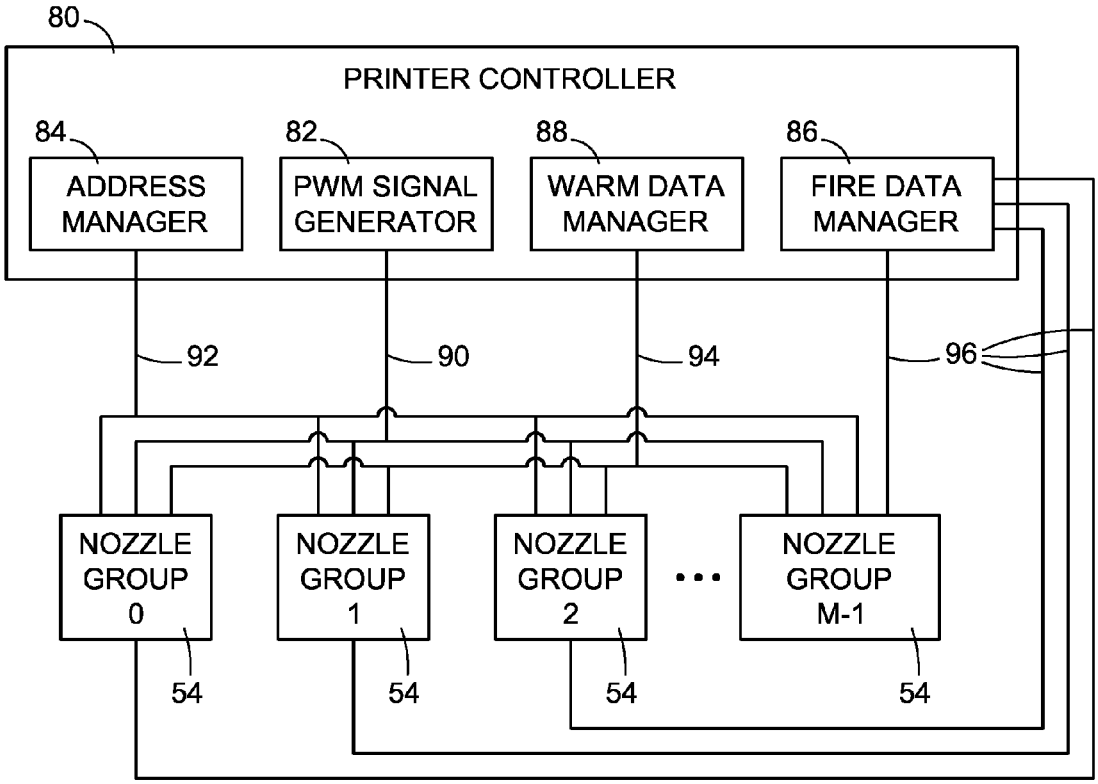
FIG. 7 is a block level circuit diagram of a printer controller coupled to a number of nozzle groups according to an embodiment.

A given fluid ejection device can include any number of nozzle groups 54. FIG. 7 illustrates a controller 80 communicating with a set of M such nozzle groups 54. Where, for example, nozzle groups 54 are components of an ink cartridge such as cartridge 10 of FIG. 1, controller 80 may be a component of a printer in which the cartridge is installed. In other examples, controller 80 or portions thereof may be located on the print cartridge itself. Controller 80 represents generally any combination of hardware and programming capable of identifying firing status for each nozzle group 54. A firing status is an indication of how a given nozzle group 54 is to conditionally modify a firing signal before the signal is to be forwarded to a selected nozzle circuit 34. In operation, controller 80 is responsible for communicating a firing signal, address data, warm data, and fire data to nozzle groups 54. In this example, controller 80 includes PWM (Pulse Width Modulated) signal generator 82, address manager 84, fire data manager 86 and warm data manager 88. PWM signal generator 82 represents generally and combination of hardware and software configured to generate a firing signal such as firing signal 46 of FIG. 4. In this example, the same generated fire signal is communicated via common bus 90 to each nozzle group 54. In another example, different firing signals could be sent to two or more of nozzle groups 54 via distinct communication paths.

Address manager 84 represents generally any combination of hardware and programming capable of communicating address data to nozzle groups 54. In this example, address manager 84 communicates the same address data to each of the nozzle groups 54 via common bus 92. Assuming that each nozzle group 54 includes N nozzle circuits 34, each nozzle group receives address data identifying one of those N nozzle circuits 34. In another example, different address data could be communicated to two or more of nozzle groups 54 via distinct communication paths.

Fire data manager 86 represents generally any combination of hardware and programming capable of communicating fire data to nozzle groups 54. In this example, fire data manager 86 communicates distinct fire data to each of the nozzle groups 54 via distinct communication lines 96. In another example, the same fire data could be communicated to two or more of nozzle groups 54 via a common communication bus.

Warm data manager 88 represents generally any combination of hardware and programming capable of communicating warm data to nozzle groups 54. In this example, warm data manager 88 communicates the same wire data to each of the nozzle groups 54 via common communication bus 94. In another example, distinct warm data could be communicated to two or more of nozzle groups 54 via distinct communication paths. Sending distinct warm data to two or more nozzle groups can prove to be beneficial, for example, if different nozzle groups have different thermal requirements and if it is required to warm by "zone" on the print head because of thermal variation across the print head.

The state of the fire data and warm data sent to a given nozzle group 54 is dependent upon the firing status identified for that nozzle group 54. If the nozzle group 54 is to fire a nozzle circuit 34, the fire data sent to that nozzle group 54 has an active state. If not, it has an inactive state. If the nozzle group 54 is to warm a nozzle circuit 34, the warm data sent to that nozzle group has an active state. If not, the warm data has an inactive state.

Figure 8:
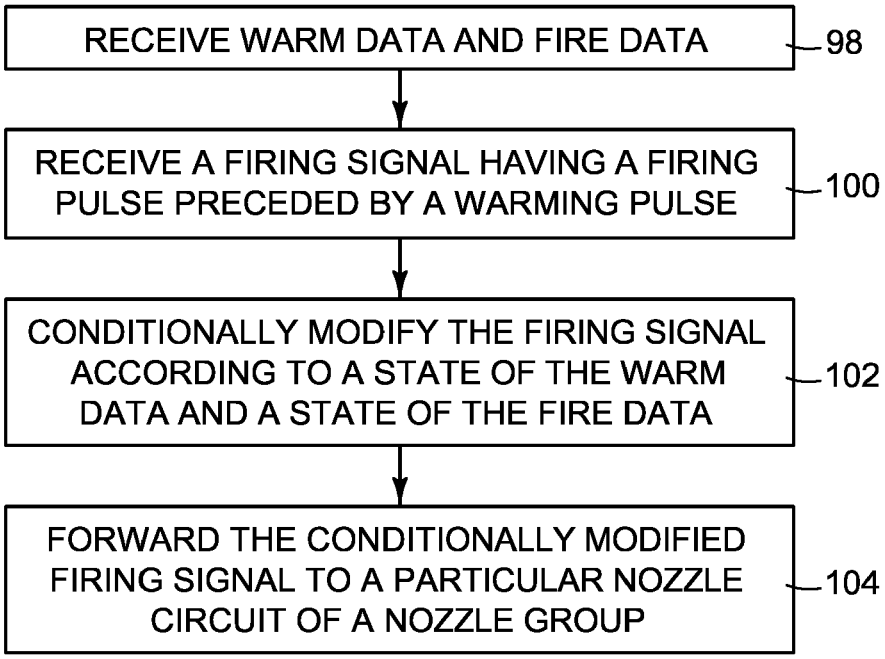
FIGS. 8 and 9 are exemplary flow diagrams illustrating steps taken to implement various embodiments.
Figure 9:
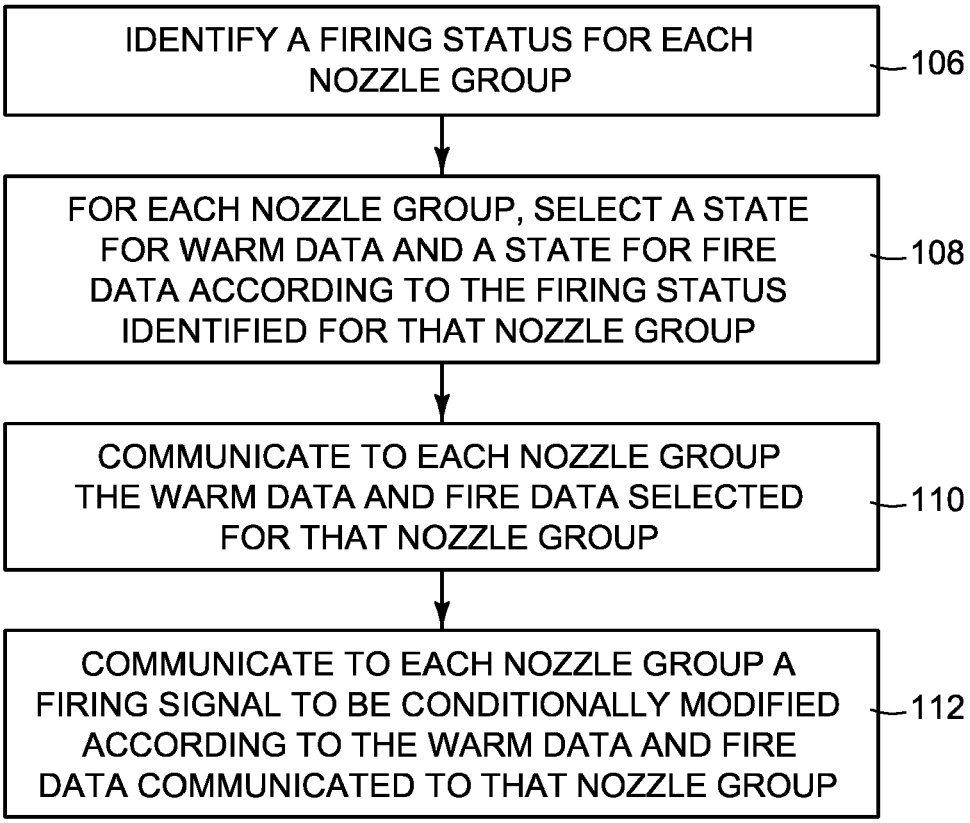

Operation:

FIGS. 8 and 9 are exemplary flow diagrams illustrating steps taken to implement various method implementations. FIG. 8 illustrates steps taken from the vantage point of a nozzle group. FIG. 9 illustrates steps taken from the vantage point of a controller communicating with a set of nozzle groups. Starting with FIG. 8, warm data and fire data are received (step 98). A firing signal is received (step 100). The firing signal has a firing pulse preceded by a warming pulse. The firing signal is conditionally modified according to a state of the fire data and a state of the warm data (step 102). The conditionally modified firing signal is forwarded to a particular nozzle circuit of a nozzle group (step 104).

Step 98 may also involve receiving address data identifying the particular nozzle circuit to which the conditionally modified fire signal is to be forwarded in step 104. In step 102, the firing signal received in step 100 can be conditionally modified by not modifying the firing signal if the fire data received in step 98 has an active state. The firing signal received in step 100 can be conditionally modified by blocking the firing pulse if the fire data received in step 98 has an inactive state and the warm data has an active state. The firing signal received in step 100 can also be conditionally modified by blocking the firing pulse and the warming pulse if the fire data received in step 98 has an inactive state and the warm data has an inactive state.

As discussed, each nozzle circuit includes a switching element and firing element, the firing element configured to heat a fluid in a vaporization chamber adjacent to a nozzle. Step 104 can include applying a conditionally modified firing signal having a firing pulse preceded by a warming pulse to the switching element of the particular nozzle circuit causing a warming current representative of the warming pulse to flow through the firing element to heat but not vaporize the fluid in the vaporization chamber. Subsequently, a firing current representative of the firing pulse is caused to flow through the firing element to vaporize the fluid ejecting a drop through the adjacent nozzle. Step 104 can include applying a conditionally modified firing signal having only a warming pulse to the switching element of the particular nozzle circuit causing a warming current to flow through the firing element to heat but not vaporize the fluid in the vaporization chamber. Step 104 can include applying a conditionally modified firing signal having only dead time to the switching element of the particular nozzle circuit.

Referring now to FIG. 9, a printer controller identifies the firing status for each of a plurality of nozzle groups (step 106). For each nozzle group, a state for warm data and a state for fire data is selected according to the firing status identified for that nozzle group (step 108). For example, if the firing signal is not to be modified, the state for the fire data is selected as active. If the firing signal is to include only a warming pulse, the state data for the fire data is selected as inactive and the state for the warm data is selected as active. If the firing signal is to include only dead time, the state data for the fire data is selected as inactive and the state for the warm data is selected as inactive.

The warm data and the fire data selected for each nozzle group are communicated to that nozzle group (Step 110). A firing signal is also communicated to each nozzle group (step 112). The firing signal sent to a given nozzle group is to be conditionally modified according to the warm data and fire data communicated to that nozzle group. Step 110 may also include communicating address data to the nozzle groups. The address data identifies a particular nozzle circuit within a nozzle group to which the conditionally modified firing signal is to be forwarded.

CONCLUSION

The environments FIGS. 1-2 are exemplary environments in which embodiments of the present invention may be implemented. Implementation, however, is not limited to these environments. The diagrams of FIGS. 3-7 show the architecture, functionality, and operation of various embodiments. Various components illustrated in FIGS. 5 and 7 are defined at least in part as programs. Each such component, portion thereof, or various combinations thereof may represent in whole or in part a module, segment, or portion of code that comprises one or more executable instructions to implement any specified logical function(s). Each component or various combinations thereof may represent a circuit or a number of interconnected circuits to implement the specified logical function(s).

Also, various embodiments can be implemented in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

Although the flow diagrams of FIGS. 8-9 show specific orders of execution, the orders of execution may differ from that which is depicted. For example, the order of execution of two or more blocks may be scrambled relative to the order shown. Also, two or more blocks shown in succession may be executed concurrently or with partial concurrence. All such variations are within the scope of the present invention.

The article "a" as used in the following claims means one or more. Thus, for example, "a hole extending through the ink holding material" means one or more holes extending through the ink holding material and, accordingly, a subsequent reference to "the hole" refers the one or more holes.

The present invention has been shown and described with reference to the foregoing exemplary embodiments. It is to be understood, however, that other forms, details and embodiments may be made without departing from the spirit and scope of the invention that is defined in the following claims.

What is claimed is:

1. A method for forwarding a firing signal within a nozzle group of a fluid ejection device, comprising:

receiving, via separate input connections to a single fire controller circuit, a first input of warm data and a second input of fire data;

receiving, via the separate input connections to the single fire controller circuit, a third input of a firing signal having a firing pulse preceded by a warming pulse;

conditionally modifying, in the single fire controller circuit, the firing signal according to a state of the warm data and a state of the fire data;

forwarding, by the single fire controller circuit, the conditionally modified firing signal to a particular nozzle circuit of the nozzle group.

2. The method of claim 1, wherein conditionally modifying comprises blocking the firing pulse if the warm data has an active state and the fire data has an inactive state.

3. The method of claim 1, wherein conditionally modifying comprises blocking the firing pulse and the warming pulse if the warm data has an inactive state and the fire data has an inactive state.

4. The method of claim 1, wherein conditionally modifying comprises not modifying the firing signal if the fire data has an active state.

5. The method of claim 1, further comprising a fourth input for receiving address data and wherein forwarding comprises forwarding the conditionally modified firing signal to a selected one of a plurality of nozzle circuits of the nozzle group, the selected nozzle circuit being identified by the address data.

6. The method of claim 1, wherein each nozzle circuit includes a switching element and firing element, the firing element configured to heat a fluid in a vaporization chamber adjacent to a nozzle and wherein forwarding comprises applying a conditionally modified firing signal having a firing pulse preceded by a warming pulse to the switching element of the particular nozzle circuit causing a warming current to flow through the firing element to heat but not vaporize the fluid in the vaporization chamber and then causing a firing current to flow through the firing element to vaporize the fluid ejecting a drop through the adjacent nozzle.

7. The method of claim 1, wherein each nozzle circuit includes a switching element and firing element, the firing element configured to heat a fluid in a vaporization chamber adjacent to a nozzle and wherein forwarding comprises applying a conditionally modified firing signal having only a warming pulse to the switching element of the particular nozzle circuit causing a warming current to flow through the firing element to heat but not vaporize the fluid in the vaporization chamber.

8. A method for directing the forwarding of firing signals within a plurality of nozzle groups of a fluid ejection device, comprising:

identifying a firing status for each of the nozzle groups via a first input to a separate input connection to a single fire controller circuit;

for each nozzle group, communicating warm data, determined via a second input to a separate input connection to the single fire controller circuit, and fire data, determined via a third input to a separate input connection to the single fire controller circuit, to that nozzle group, the warm data and fire data each having a state selected according to the firing status identified for that nozzle group; and for each nozzle group, communicating a firing signal having a warming pulse and a firing pulse to that nozzle group, conditionally modified in the single fire controller circuit based on the selected states for the warm data and the fire data, according to the warm data and the fire data communicated to that nozzle group.

9. The method of claim 8, wherein, for a given nozzle group:

identifying a firing status comprises identifying firing status indicating a warm only status;

communicating warm data and fire data comprises communicating warm data with an active status and communicating fire data with an inactive status indicating that the firing signal communicated to that nozzle group is to be conditionally modified by blocking the firing pulse.

10. The method of claim 8, wherein, for a given nozzle group:

identifying a firing status comprises identifying a firing status as an off status;

communicating warm data and fire data comprises communicating warm data with an inactive status and communicating fire data with an inactive status indicating that the firing signal communicated to that nozzle group is to be conditionally modified by blocking the firing pulse and the warming pulse.

11. The method of claim 8, wherein, for a given nozzle group:

identifying a firing status comprises identifying a firing status as a fire status;

communicating fire data comprises communicating fire data with an active status indicating that the firing signal communicated to that nozzle group is to be conditionally modified by not modifying the firing signal.

12. The method of claim 8, further comprising, for each nozzle group, communicating address data to that nozzle group, the address data identifying one of a plurality of nozzle circuits within the nozzle group to which a conditionally modified firing signal is to be forwarded.

13. The method of claim 12, wherein the same address data is communicated to each of a plurality of nozzle groups.

14. The method of claim 13, wherein the same firing signal, warm data, and address data are communicated to the plurality of nozzle groups and a unique firing signal is sent to each of the plurality of nozzle groups.

15. A nozzle group for a fluid ejection device, comprising a plurality of nozzle circuits and a single fire controller circuit in electronic communication with the plurality of nozzle circuits and wherein:

the single fire controller circuit includes a first data input, for receiving fire data, a second data input for receiving warm data, and a third input for receiving a firing signal having a firing pulse preceded by a warming pulse;

the single fire controller circuit is operable to conditionally modify the firing signal according to a state of warm data received via the warm data input and a state of fire data received via the fire data input; and the single fire controller circuit is operable to forward the conditionally modified firing signal to one of the plurality of nozzle circuits.

16. The nozzle group of claim 15, wherein the single fire controller circuit is operable to conditionally modify the firing signal by not modifying the firing signal if the fire data received via the fire data input has an active state.

17. The nozzle group of claim 15, wherein the single fire controller circuit is operable to conditionally modify the firing signal by blocking the firing pulse if the warm data received via the warm data input has an active state and the fire data received via the fire data input has an inactive state.

18. The nozzle group of claim 15, wherein the single fire controller circuit is operable to conditionally modify the firing signal by blocking the firing pulse and the warming pulse if the warm data received via the warm data input has an inactive state and the fire data received via the fire data input has an inactive state.

19. The nozzle group of claim 15, wherein the single fire controller circuit includes an fourth input for receiving address data identifying a particular one of the plurality of nozzle circuits and wherein the single file controller circuit is operable to forward the conditionally modified firing signal to the particular nozzle circuit identified by address data received via the address input.

20. The nozzle group of claim 15, wherein each nozzle circuit includes a switching element and firing element, the resistive element configured to heat a fluid in a vaporization chamber adjacent to a nozzle, the switching and resistive elements are configured such that:

when a conditionally modified signal having a firing pulse preceded by a warming pulse is forwarded to the nozzle circuit and applied to the switching element, a warming current allowed to flow through the firing element causing the firing element to heat but not vaporize the fluid in the vaporization chamber and then a firing current is allowed to flow through the firing element causing the firing element to vaporize the fluid ejecting a drop through the adjacent nozzle; and when a conditionally modified signal having only a warming pulse is forwarded to the nozzle circuit and applied to the switching element, a warming current is allowed to flow through the firing element causing the firing element to heat but not vaporize the fluid in the vaporization chamber.

* * * * *

UNITED STATES PATENT AND TRADEMARK OFFICE

CERTIFICATE OF CORRECTION

PATENT NO. : 8,348,373 B2
APPLICATION NO. : 12/867053
DATED : January 8, 2013
INVENTOR(S) : Eric T. Martin et al.

It is certified that error appears in the above-identified patent and that said Letters Patent is hereby corrected as shown below:

Title page, item (57), Abstract, in column 2, line 5, delete "to" and insert -- to a state of the warm data and a state --, therefor.

In column 9, line 15, in Claim 19, delete "file" and insert -- fire --, therefor.

Signed and Sealed this
Second Day of April, 2013

Teresa Stanek Rea
*Acting Director of the United States Patent and Trademark Office*